US006227620B1

(12) United States Patent
Page

(10) Patent No.: US 6,227,620 B1
(45) Date of Patent: May 8, 2001

(54) FORWARD MOUNTED ASPHALT ROAD MILL APPARATUS

(76) Inventor: James H. Page, 1405 Sinclair St. South, Bottineau, ND (US) 58318

( * ) Notice: Subject to any disclaimer, the term of this patent is extended or adjusted under 35 U.S.C. 154(b) by 0 days.

(21) Appl. No.: 09/145,583

(22) Filed: Sep. 2, 1998

(51) Int. Cl.[7] ..... E01C 23/09; E21C 31/10

(52) U.S. Cl. ..... 299/39.4; 299/39.2; 299/39.6; 299/39.5; 125/13.03; 404/86; 451/236

(58) Field of Search ..... 125/13.03; 451/236, 451/280, 352, 353, 434; 404/86, 101, 93, 108, 128, 90, 91; 37/403, 903, 468; 299/36.1, 39.1, 39.2, 39.4, 39.5, 39.6

(56) References Cited

U.S. PATENT DOCUMENTS

| | | | | |
|---|---|---|---|---|
| 3,606,469 | | 9/1971 | Hughes . | |
| 4,175,886 | | 11/1979 | Moench et al. . | |
| 4,411,081 | | 10/1983 | King . | |
| 4,704,045 | | 11/1987 | Taylor et al. . | |
| 4,803,789 | | 2/1989 | Hackmack . | |
| 4,878,713 | * | 11/1989 | Zanetis | 299/39.5 |
| 5,060,732 | | 10/1991 | Baskett . | |
| 5,236,278 | | 8/1993 | Dickson . | |
| 5,378,080 | | 1/1995 | Dickson . | |
| 5,378,081 | * | 1/1995 | Swisher, Jr. | 299/39.5 |
| 5,388,893 | | 2/1995 | Maxwell et al. . | |
| 5,421,669 | | 6/1995 | Bertrand . | |
| 5,850,704 | * | 12/1998 | Harinen | 37/403 X |
| 5,893,677 | * | 4/1999 | Haehn et al. | 299/39.4 X |
| 6,116,699 | * | 9/2000 | Kaczmarski et al. | 299/39.5 |

FOREIGN PATENT DOCUMENTS

| | | |
|---|---|---|
| 3420-989 | 12/1985 | (DE) . |
| 296847 | 2/1971 | (SU) . |

OTHER PUBLICATIONS

Model 78B Asphalt Recycler brochure, © Maddock Corporation at least before Sep. 30, 1997.
Industry Advertisement placed by Guest Industries, Inc. in Public Works, Aug. 1997, p. 101.

* cited by examiner

*Primary Examiner*—David Bagnell
*Assistant Examiner*—Sunil Singh
(74) *Attorney, Agent, or Firm*—Moore & Hansen

(57) ABSTRACT

A compact, easily transportable, surface preparation or road mill apparatus which includes a road mill housing or surface treatment unit having a cutter drum powered by its own power source. The apparatus also includes a mounting device for attachment of a working machine, such as the road mill housing, to a land vehicle having a lifting mechanism, preferably of the type provided on "front-end loaders". The surface treatment unit or road mill housing preferably has an opening for receiving a cylindrical shaft and the mounting device includes an attachment device for attachment to a land vehicle and an interconnected cylindrical shaft upon which the road mill housing can be secured once the shaft is received within the shaft receiving opening.

45 Claims, 12 Drawing Sheets

FORWARD MOUNTED ASPHALT ROAD MILL APPARATUS

BACKGROUND OF THE INVENTION

The present invention relates to a forward mounted asphalt road mill apparatus for attachment to and use in conjunction with a front-end loading land vehicle or the like having a loading bucket or other lifting mechanism. The preferred road mill apparatus includes a road mill housing and a mounting device for multiple tool attachment. The preferred mounting device includes a cylindrical shaft upon which a working machine, such as the road mill housing, may be secured. the present invention also includes a mounting device of the type described above.

Road surfaces, particularly asphalt road surfaces form a majority of road surfaces in the United States. Asphalt is also used in other applications, such as parking lots, biking paths, walking paths and the like. A problem with asphalt is that is has a limited useful life. When that useful life has been exceeded, the surface must be replaced or rehabilitated. The conventional units generally used to replace such surfaces are generally large machines capable only of replacing the entire surface area. Often, however, it is not desirable or cost effective to rehabilitate the entire road surface, particularly when only portions or segments of a paved section have deteriorated. As a result, the road surface is allowed to continue to deteriorate until use of a conventional full surface surfacing unit becomes cost effective. The need to wait until the use of conventional resurfacing units becomes cost effective, results in temporary repairs such as patching, which are not as desirable as resurfacing. However, without a more cost effective manner resurfacing small areas, or portions of larger areas, resurfacing which might otherwise be completed if smaller, more flexible resurfacing units were available, will be deferred. Furthermore, there will be a tendency to redo surfaces which might not need to be done because only larger areas can be accommodated by the larger conventional units. Conventional units tend to be very large and heavy. They are often self propelled or attached to existing vehicle frames. The power for such units is generally supplied by one unit which means that some of the power is used to drive the vehicle and some of the power is used in the surface treatment apparatus. For this reason, those units are also very slow. In addition, they can only be used to resurface large areas. It will be appreciated, therefore, that a need exists for smaller devices which are easily transportable, efficient for reconditioning or replacing portions of larger asphalt surface areas, and flexible in terms of the types of replacements which can be done.

Smaller pavement milling apparatus have been previously disclosed. Fowkes (U.S. Pat. No. 3,608,969) discloses a pavement milling apparatus having a frame, a manual cutting head with cutting teeth, an internal combustion engine power plant, a power transmitting mechanism, a torque amplifying mechanism, an adjustable gage, a cover. Taylor et al. (U.S. Pat. No. 4,704,045) discloses an apparatus for pulverizing asphalt including a rotating drum with removable cutting tips which engage the roadway. The apparatus is designed for receiving and rotating varies widths of rotating drums and is adaptable for moving the drum along the width of a mobile piece of equipment supporting the apparatus and adjacent a curb and gutter of a roadway. Numerous other patents, notably Guest (U.S. Pat. No. 3,864,793); King (U.S. Pat. No. 4,411,081); Baskett U.S. Pat. No. 5,060,732); Hackmack (U.S. Pat. No. 4,803,789); and Maxwell et al. (U.S. Pat. No. 5,388,893), disclose mechanism for attaching working machines to loading buckets on front-end loaders. Several of these patents disclose rotating drums and, of those, Hackmack and Maxwell et al. disclose rotating milling devices for pulverizing soil and the like.

Accordingly, it will be appreciated that there is a need for an efficient way to attach a asphalt road milling device to a loading bucket of a front-end loader so that such a device may be efficiently used to resurface asphalt, concrete in other surfaces used for roadways, walkways, parking lots and the like. The present invention provides advantages over the prior devices and the prior methods used to resurface these and other surfaces and will also offer advantages over the prior art and solve other problems associated therewith.

SUMMARY OF THE INVENTION

The forward mounted asphalt road mill apparatus of the present invention is compact, easily transportable and includes a surface treatment unit which has a cutter drum powered by its own power source. The apparatus includes a road mill housing having a rotatable cutter drum and a mechanism for driving the cutter drum; and a mounting device for attaching the road mill housing to a lifting mechanism attached to a land vehicle, preferably a loading bucket of a front-end loader or the like. The housing is easily transportable in a pickup truck or the like. The mounting device for attachment of the road mill housing to a land vehicle includes a cylindrical shaft upon which the housing may be secured, and the housing includes a shaft receiving opening for receiving the cylindrical shaft. Preferably, the road mill apparatus of the present invention further comprises an adjustable length connecting arm interconnecting the housing to the mounting device. The connecting arm is preferably oriented such that the housing will pivot about the cylindrical shaft with respect to the mounting device when the length of the connecting arm is changed. The connecting arm is preferably a hydraulic cylinder which is actuated remotely from the cab of the front-end loader or other prime mover having a forwardly mounted lifting mechanism. Preferred embodiments of the mounting device will be designed and constructed to engage a standard attachment mechanism such as a "quick attach" mechanism, a loading bucket, or the like.

The surface preparation apparatus of the present invention is compact, easily transportable, and includes a surface treatment unit which has a surface modifier or "cutter drum" powered by its own power source. The surface modifier or cutter drum is preferably off-set relative to the transverse aids of the surface treatment unit such that the surface modifier operates substantially to one side of the surface treatment unit.

One objective of the present invention is to provide a surface preparation apparatus which may be easily transported in or on vehicle or attached to a lifting mechanism of a vehicle.

Another objective is to create a compact surface preparation apparatus which is useful to efficiently recondition small sections of deteriorated asphalt surfaces.

A further objective is to rehabilitate surfaces of various widths and compositions.

Another objective is to reduce the potential of injury due to flying debris.

Another object is to provide an apparatus which will move the debris from the treated surface area.

These and various other advantages and features of novelty that characterize the present invention are pointed out with particularity in the claims annexed hereto informing a part hereof. However, for a better understanding of the present invention, its advantages and other objects obtained by its use, reference should be made to the drawings, which form a further part hereof and to the accompanying descriptive matter, in which there is illustrated and described preferred embodiments of the present invention.

BRIEF DESCRIPTION OF THE DRAWINGS

The invention will be further described in connection with the accompanying drawings, in which like and primed reference numbers reference like features or aspects of the various embodiments of the present invention:

FIG. 9A showing the road mill housing in a generally horizontal orientation to the bucket mounting device when the adjustable connecting arm is extended to an intermediate length and the cutter drum is in a generally horizontal orientation with resect to the ground surface; FIG. 9B being similar to FIG. 9A, but showing the adjustable connecting arm in a contracted position causing the road mill housing to be pivoted on a cylindrical shaft in respect to the bucket mounting device from the position shown in FIG. 9A and enabling the cutter drum to engage the ground surface at an angle to a generally horizontal plane provided by the ground surface; and FIG. 9C depicts a forward mounting asphalt road mill apparatus similar to FIGS. 9A and 9B except that the adjustable connecting arm is extended such that the housing is pivoted in the opposite direction of that shown in FIG. 9B such that the cutter drum is at a different angle with respect to the generally horizontal plane represented by the ground surface;

DETAILED DESCRIPTION OF THE PREFERRED EMBODIMENTS

Figure 1:
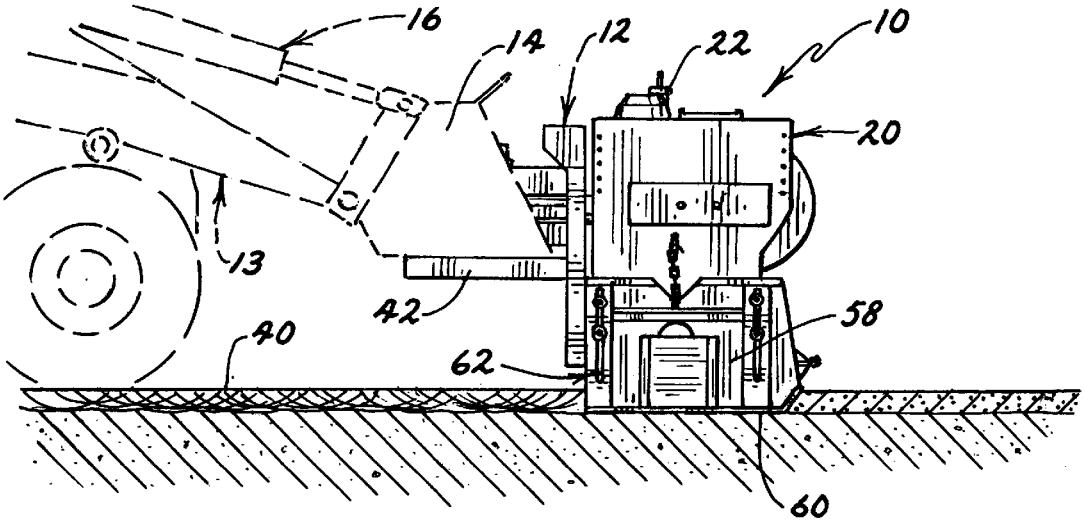
FIG. 1 is a side view of a generalized embodiment of a forward mounted asphalt road mill apparatus of the present invention shown engaged with a loading bucket of a front-end loader shown in phantom.

The present invention includes a road mill apparatus 10 having a mounted device 12 and a road mill housing 20 including an engine 22 and a rotating cutter drum 24 (not shown) driven by the engine 22. The housing 20 is disengageably engaged with the mounting device 12 for attachment to a lifting mechanism 13 on a land vehicle 16. The cutter drum 24 (not shown) rotates within a cutter drum chamber 26 (not shown) in a manner consistent with alternate embodiments of the housing described herein below, and the housing 20 can have any of the features of those embodiments unless otherwise indicated. When resting on a ground surface, the housing 20 rests on sidewalls and at least one skid bar (not shown) located on the inside of the cutter drum chamber 26 (not shown), immediately adjacent to the cutter drum 24 (not shown). The cutter drum chamber 26 (not shown) lies immediately behind the adjustable skirt 58 which can slide up or down relative to the other parts of the housing. Although the adjustable skirt 58 has a skid bar 60, that skid bar does not bear the weight of the housing 20.

Referring now also to FIGS. 2–8, an alternate embodiment of the forward mounted asphalt road mill apparatus 10 includes a bucket mounting device 12' for attachment to a loading bucket 14' of a front-end loader 16'. The road mill apparatus 10' also includes an adjustable connecting arm 18' (shown in FIG. 7) and a road mill housing 20'. Within the housing is an engine 22' which drives a rotating cutter drum 24' which resides within a cutter drum chamber 26' within the housing 20'.

When engaged together, as shown in FIGS. 2,3,4 and 7 the housing 20' and mounting device 12' provide an effective forward mounted asphalt road mill apparatus 10'. The depth of the cut can be adjusted with an adjustable depth gauge 63' including and adjustable support wheel 64'. the depth gauge 63' is adjustable by adjusting the distance between the support wheel 64' and a depth gauge housing 65'. This can be done either manually or automatically using mechanical and electronic/hydraulic mechanisms and controls which are well known.

Figure 4:
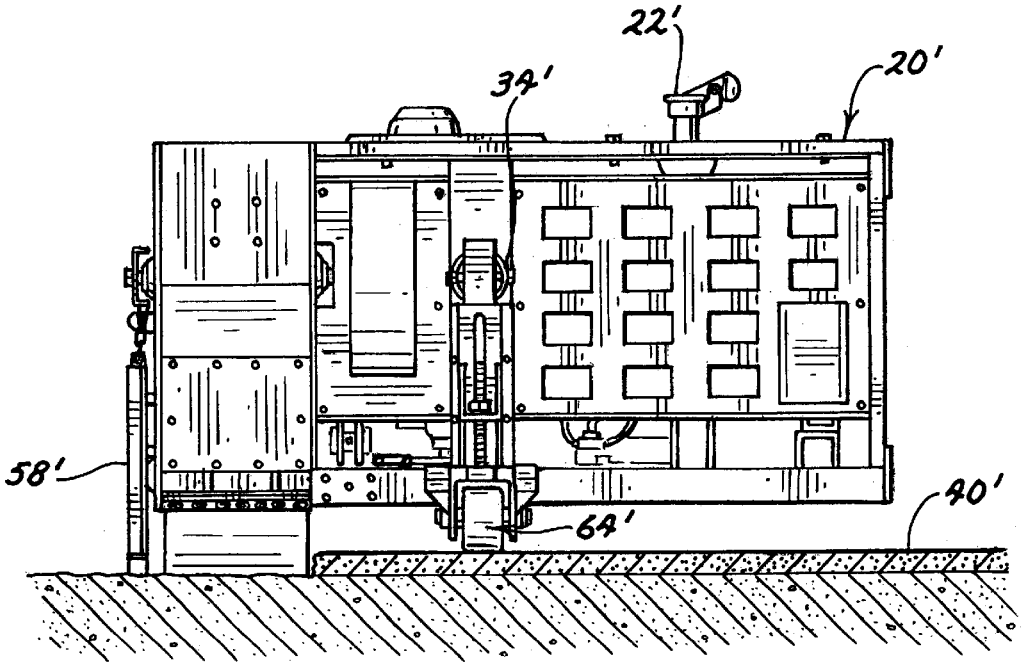
FIG. 4 is a front view of the road mill housing of the forward mounted asphalt road mill apparatus shown in FIG. 2.
Figure 5:
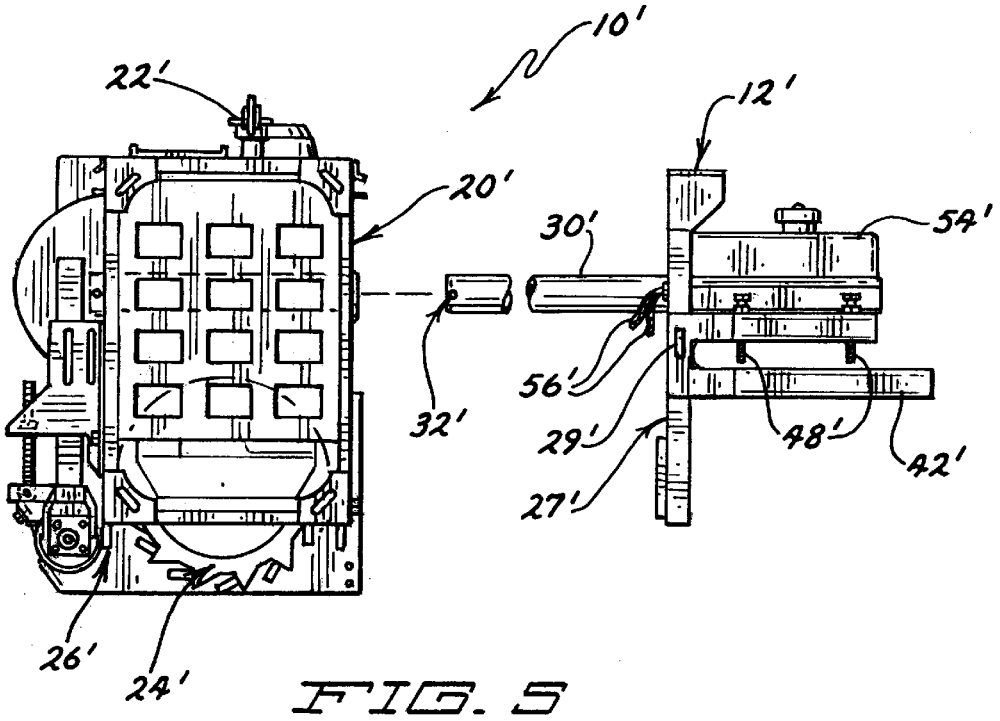
FIG. 5 is an exploded side view of the forward mounted asphalt road mill apparatus shown in FIGS. 2 and 3 but from the opposite side as that shown in FIG. 3 and showing only the road mill housing and the mounting device when disengaged, and not showing the adjustable connecting arm or hydraulic cylinder shown in subsequent FIGS. 7 and 8.
Figure 6:
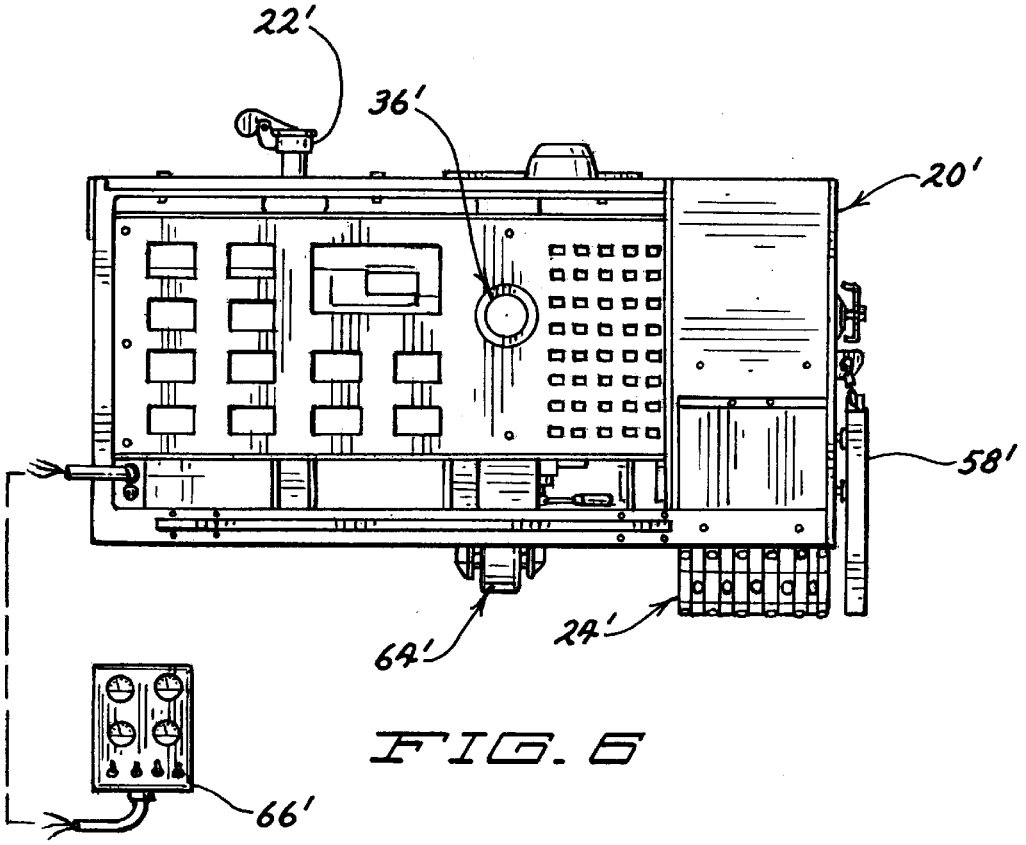
FIG. 6 is a rear view of the road mill housing shown in FIG. 5 when disconnected from the mounting device, which shows the electronic actuating mechanism used to control various functions of road mill apparatus.
Figure 7:
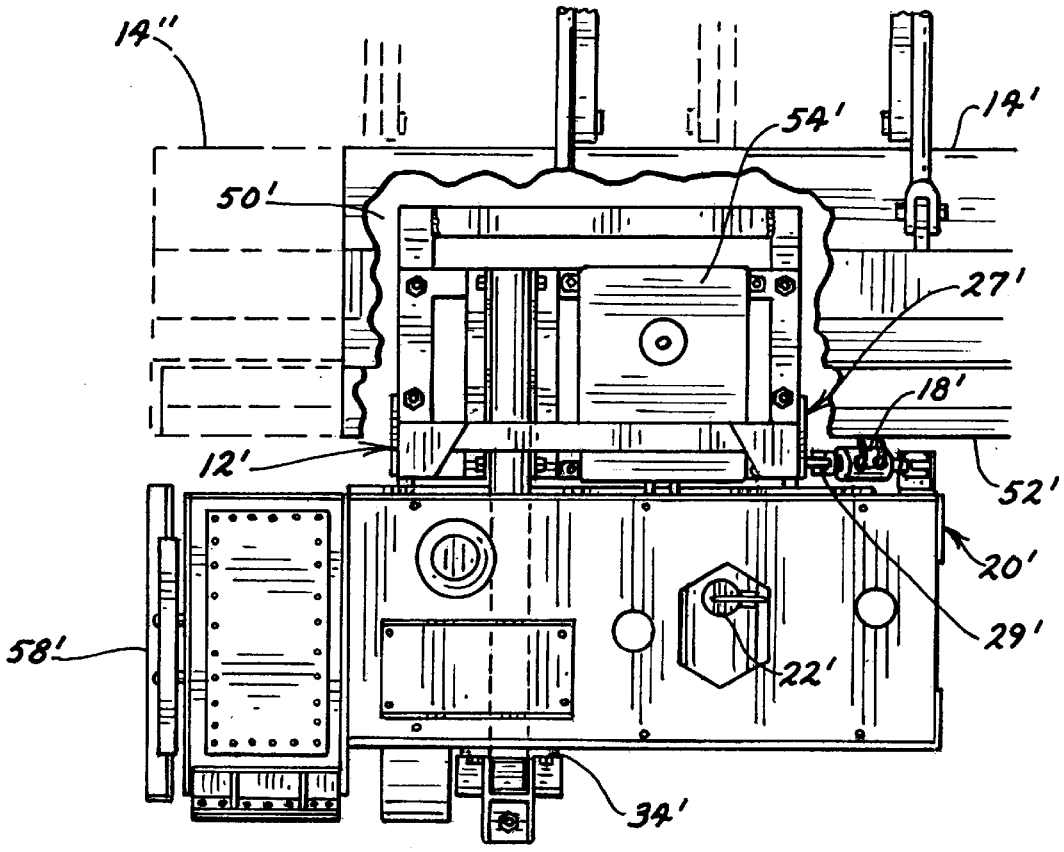
FIG. 7 is a plan view of the forward mounted asphalt road mill apparatus shown in FIGS. 2–6, but showing the loading bucket partially broken away and showing an alternate loading bucket in phantom in a different position in sect to the road mill housing, where the alternate loading bucket is generally aligned with the road mill housing such that the cutter drum is within the outer width parameters of the loading bucket alternate.

As shown particularly in FIG. 5, the bucket mounting device 12' includes a cylindrical shaft 30' including a pin receiving cannula 32' through which a securing pin 34' (shown in FIG. 4) is passed to secure the housing 20' to the mounting device 12'. The housing 20' includes a shaft receiving opening 36' extending entirely though the housing 20' which will receive the cylindrical shaft 30' when the housing 20' is engaged with the bucket mounting device 12'.

Figure 8:
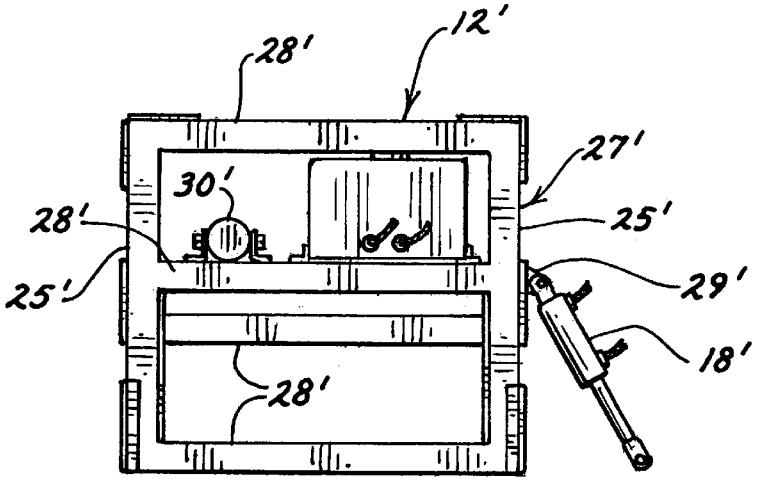
FIG. 8 is a front view of the mounting device shown in FIG. 5 and also showing an adjustable connecting arm which is interconnected with the mounting device as it is when the mounting device is engaged with the road mill housing (not shown)

The mounting device 12' shown in FIGS. 5 and 8 is designed and constructed specifically to clamp down on a loading bucket 14. A frame 27' is provided which includes several tool bars 28' which are generally disposed in a horizontal orientation when the mounting device 12' is engaged with a loading bucket 14' when the top surface 50' of the bottom side 52' of the loading bucket 14' is generally oriented in a horizontal position. A fuel tank 54' having fuel lines 56' to transfer fuel to the engine 22' is preferably attached to one of the tool bars 28' as is the cylindrical shaft 30'. A mounting bracket 29' is also provided on the outside of the frame 27' so that a connecting arm 18' can be attached to adjustably connect the mounting device 12' with the housing 20'.

Figure 9A:
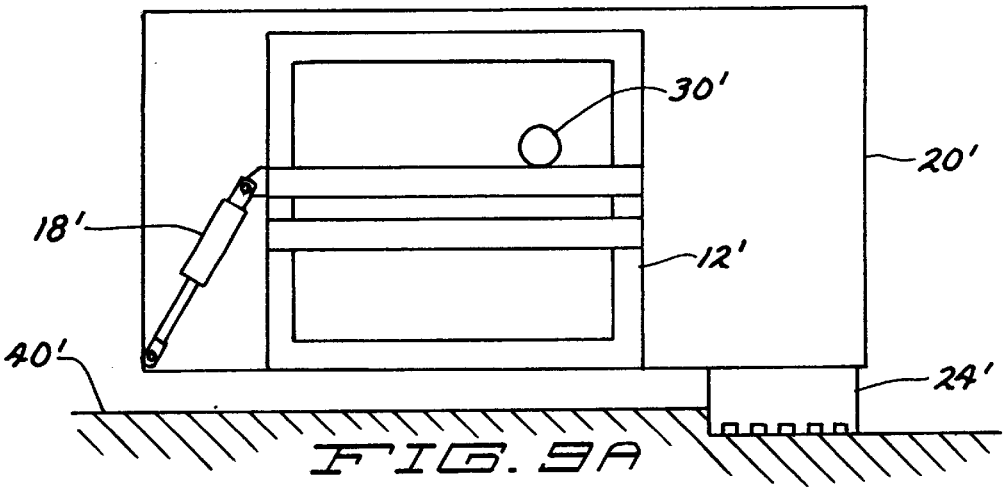
FIGS. 9A, 9B, and 9C are schematic diagrams of a forward mounted asphalt road mill apparatus, similar to that shown in FIG. 2, during use.
Figure 9B:
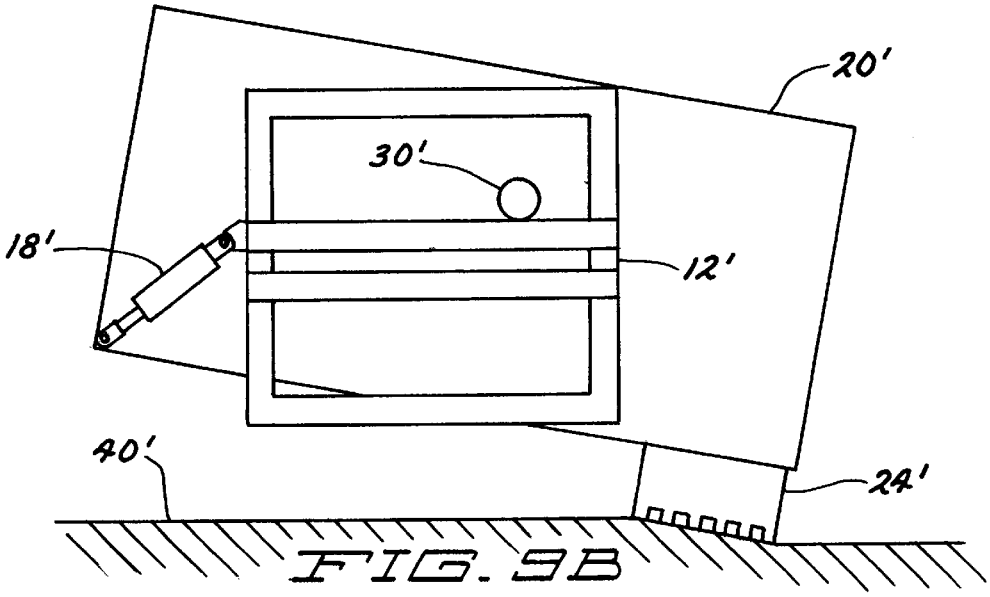
Figure 9C:
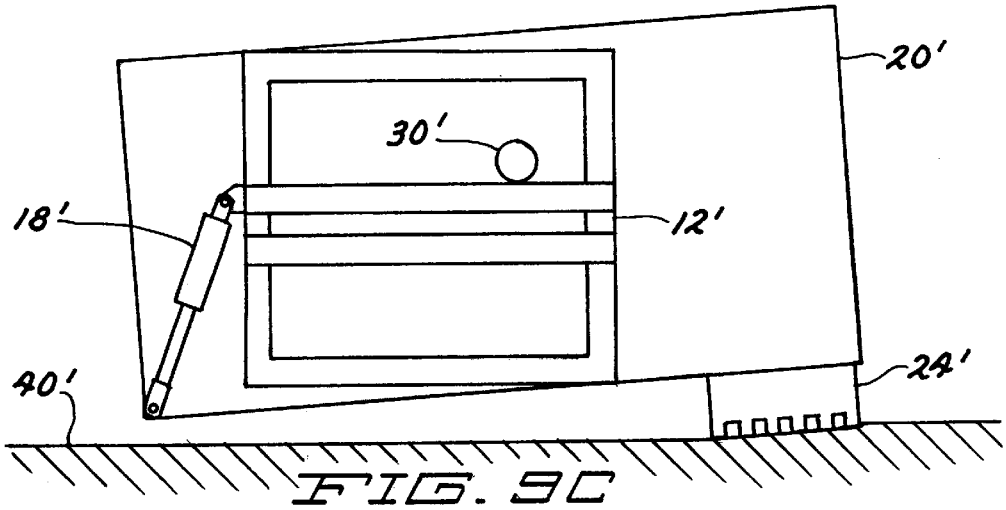

When mounted on the bucket mounting device, the adjustable connecting arm 18', preferably a hydraulic cylinder, interconnects the housing 20' with the mounting device 12' in a manner which enables the housing 20' to pivot within a generally vertical plane about the cylindrical shaft 30' when the cylindrical shaft 30' resides in a generally horizontal plane, if the adjustable connecting arm is either extended or contracted from an intermediate extension orientation when the housing 20' and the mounting device 12' reside generally in a horizontal plane and are generally residing in planes which are parallel with one another as shown schematically in FIG. 9A. Referring now also to FIG. 9B, the housing may be rotated clockwise about the cylindrical shaft 30' when viewed from the rear, when the adjustable connecting arm 18' is contracted from the intermediate orientation shown in FIG. 9A. In this position, the cutter drum 24' will engage the ground surface 40' at an angle to a horizontal surface similar to that shown. As shown in FIG. 9C, the housing 20' may also be rotated counter clockwise about the cylindrical shaft 30 as seen from the rear when the adjustable connecting arm 18' is extended beyond the intermediate extension shown in FIG. 9A. In this case, the cutter drum will also sit at an angle to the generally horizontal ground surface shown in the Figures.

Although a hydraulic cylinder 18' is the preferred adjustable connecting arm, it will be appreciated that a turnbuckle (not shown) may also be used to adjust the length of the adjustable connecting arm. However, in such a case, the length of the adjustable connecting arm 18' will not be readily adjustable. Nor will it be adjustable during operations, as is generally desired. For that reason the use of a hydraulic cylinder is preferred, preferably one which is remotely controllable from a cab of the front-end loader 16' or other prime mover using electronic hydraulic controls 41'. Such controls are well known and may be provided along with additions controls for started, stopping, accelerating and decelerating the engine 22' which drives the cutter drum 24'.

In preferred embodiments, the forward mounted asphalt road mill apparatus 10' of the present invention is a "right-handed" machine which can extend 3 degrees from a generally horizontal plane to the left (counter clockwise as viewed from the rear of the housing) and up to 12 degrees to the right (clockwise as viewed from the rear of the housing) when a hydraulic cylinder 18' is used which can extend from a contracted length of 20 inches to a fully extended length of 28 inches. It will be appreciated, however, that the housing 20' may be rotated to a larger degree in either direction depending on the length of the adjustable connecting arm 18' when fully contracted and when fully extended and upon the respective connection points to the mounting device 12' and the housing 20'. It will be appreciated that any known adjustable length connecting arm may be used to accomplish this function, and that the arm need not necessarily be automated, but that, if it is automated or remotely controlled, any known system for providing such control can be used and is fully contemplated to fall within the scope of the present invention.

The cutter drum 24' rotates about an axis (not shown) within a cutter drum chamber 26' in the housing 20'. The cutter drum may have any width or diameter, however, preferred cutter drums have a width of from about 1 inch to about 26 inches preferably having widths of 1, 2, 8, 14, 20, 26 inches. Optional 8 inch and 12 inch widths can also be used. The cutter drum preferably includes quick change bits and bit holders, preferably kennemetal quick change bit holders and blocks or the like, wherein ½ inch bit spacing is preferred. The cutter drum 24' preferably rotates in a clockwise direction when seen from the side shown in FIG. 5, so that the cutter drum 24' pulverizes asphalt or other pavement by striking it from below when moving upward in a forward direction.

The bucket mounting device 12' includes a pair of side bars 25' which are interconnected by a plurality of tool bars 28' to form the frame 28' of the mounting device 12'. The cylindrical shaft 30' is preferably secured to at least one of the tool bars 27'. U-shaped side pieces 42' each have a pair of mounting pins 48' which can be screwed down onto a top surface 50' of the bottom side 52' of the bucket 14 to secure the bucket mounting device 12' to the bucket 14' are provided to secure the mounting device 12' to the bucket 14'. When the top surface 50' of the bottom side 52' of the bucket 14' is in a generally horizontal plane and the bucket mounting device 12' is engaged with the bucket 14', the surfaces of each of the tool bars 28' of the bucket mounting device 12' will lie generally in a horizontal plane parallel with the generally horizontal plane in which the top surface 50' lies.

The housing 20' preferably includes an adjustable skirt 58' which partially defines the cutter drum chamber 26' the skirt 58' includes a skid surface 60' which permits the skirt to slide along the ground. The skirt 58' is engaged with the housing on bolts 61' which slide within slots 62' which permit the skirt 58' to rise and fall to a limited degree depending on the height of the ground surface approximate the skid surface 60'. As shown in FIG. 4, the road mill housing 20' also includes an adjustable support wheel 64' discussed above which may be used to set the distance between the housing 20' and the ground surface 40' proximate the support wheel 64'. In alternate embodiments (not shown) the adjustable support wheel may be replaced by a series of skid bars, or perhaps a single skid bar, the height of which will be varied so as to vary the distance between the bottom of the housing 20' and the ground surface 40' proximate the placement of the selected skid bar. In preferred embodiments, controls for the engine and all hydraulic cylinders of the apparatus 10' are provided. Such controls are TO preferably available in a remote control box 66' which can be placed in the cab of the land vehicle 16', front-end loader or other prime mover.

In alternate embodiments of the present invention, the bucket mounting device has a width which is less than the standard width of a loading bucket, generally about 8 feet, by an amount equal to or greater than the width of the cutter drum 24' so that the width of the cutter drum 24' may be outside of the width parameters of the loading bucket 14'. This enables the operator of the apparatus to sit in the front-end loader 16' or prime mover and watch the cut without having an obstructed view of the results. Furthermore, when the cutter drum 24' extends outside of the parameters of the standard loading bucket 14', because the wheels or other traction mechanism driving the prime mover 16', are generally within the width parameters of the loading bucket 14', the wheels or traction mechanism remain on the undisturbed surface over which the road mill housing 20' has passed and the cut created by the cutter drum 24' as the housing 20' passes over the surface will be outside of the width parameters of the loading bucket 14'. This is helpful in that it allows the prime mover 16' and the housing 20' to remain in a generally level orientation with respect to the ground surface without a need to straddle the inside edge of the cut as would be required if the cutter drum 24' were within the outside width parameters of the bucket 14' in the case of most front-end loaders 16' or prime movers.

Figure 11:
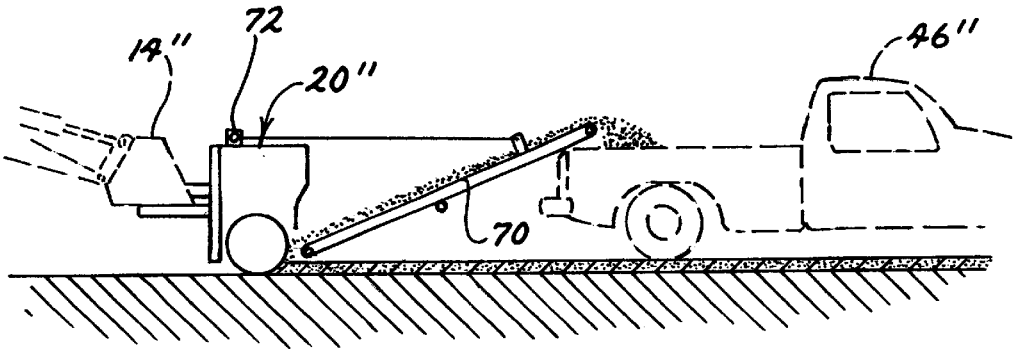
FIG. 11 is a schematic view of an alternate housing similar to that shown in FIG. 10 engaged with a bucket mounting device of the present invention, similar to that shown in FIG. 2, which is in turn engaged with a loading bucket of a front-end loader shown in phantom, and also showing pickup truck in phantom forward of the hydraulic conveyor belt to receive pulverized surface material.
Figure 10:
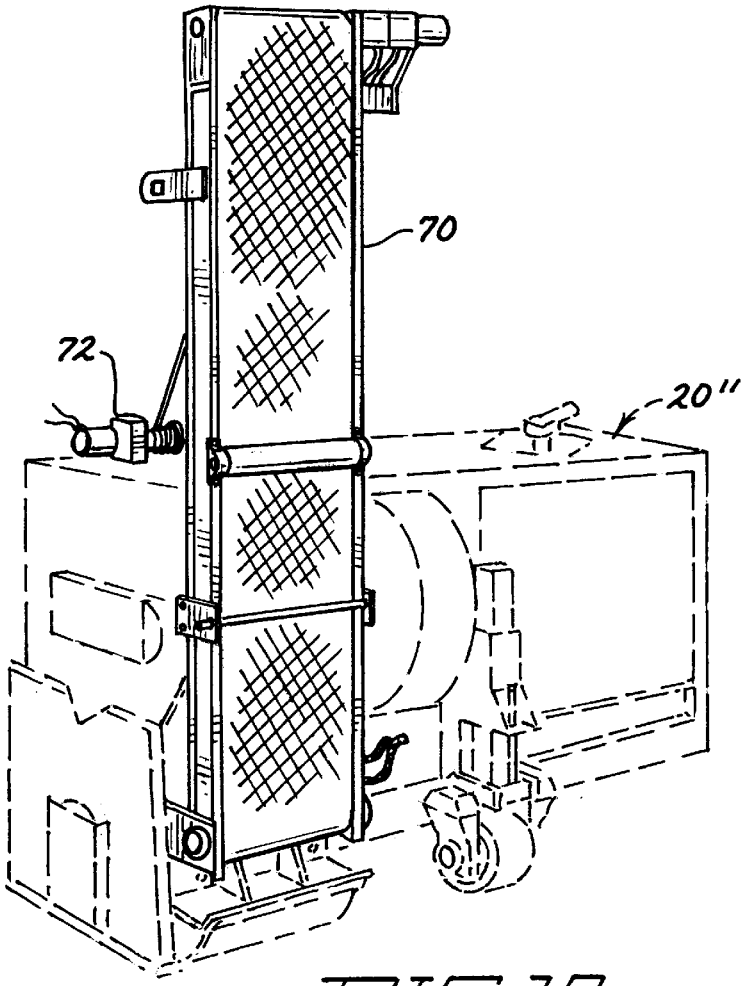
FIG. 10 is a perspective view of a hydraulic conveyor belt of an alternate embodiment of the present invention showing segments of a generalized road mill housing, similar to that shown in FIG. 2, in phantom with the exception of connection member.

Referring now also to FIGS. 10 and 11, a further alternate housing 20" is equipped with a hydraulic conveyor belt 70 which may also be controlled electronically by a control box 66" (not shown). The conveyor belt 70 is pivotally attached to the housing 20" and can be lowered into position and raised using an electronic wench 72 which may also be actuated electronically by controls in an alternate control box 66' (not shown) similar to that shown in FIG. 6. When lowered into position as shown in FIG. 11, the conveyer 70 can convey pulverized road materials from an opening to the cutter drum chamber 26" to a vehicle 46' in position to collect such material.

Figure 12:
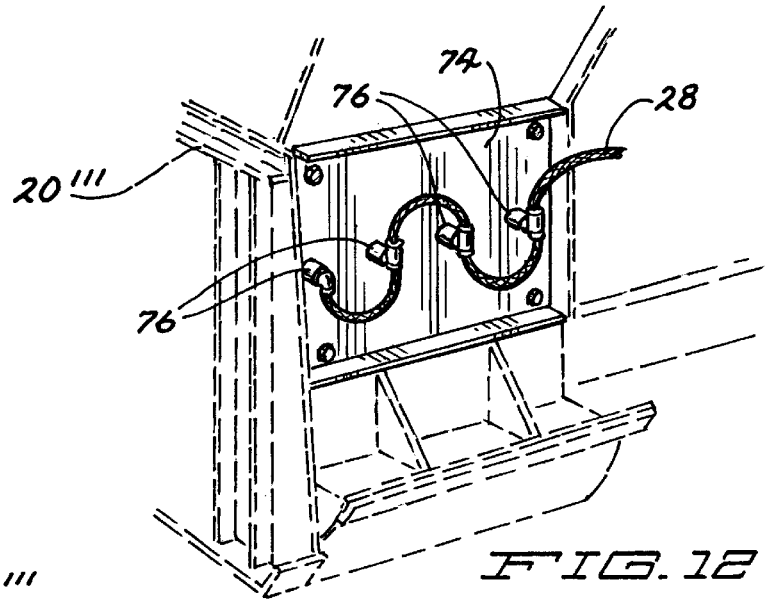
FIG. 12 is a perspective view of an alternate housing plate attached to a portion of a alternate housing proximate the cutter drum (not shown), showing fluid conduit apparatus for delivering fluids such as polymer modified emotions or water suspended asphalt into a grinding chamber within the alternate housing to be mixed with asphalt or other ground surface material pulverized by the cutter drum.
Figure 13:
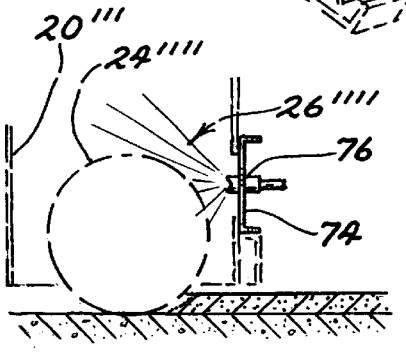
FIG. 13 is a schematic view of the cutter drum chamber of an alternate housing similar to that shown in FIG. 12 showing a liquid spray emerging from a spray nozzle inside the cutter drum chamber.

Referring now also to FIGS. 12 and 13, a further embodiment of the housing 20'" fit includes a front plate 74 having a series of spray nozzles 76 interconnected by a fluid conduit 78 which communicates from a fluid storage reservoir (not shown) for storage of water suspended asphalt or other polymer modified emulsions for treating pulverized asphalt or other surface materials pulverized by the cutter drum 24'" during operation of the alternate apparatus 10'".

Figure 15:
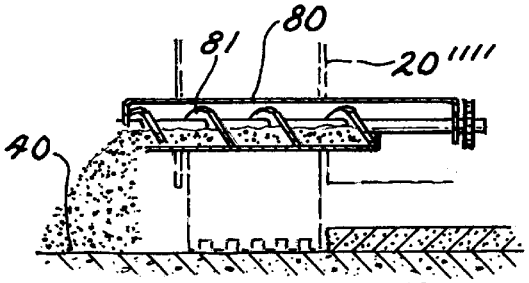
FIG. 15 is a partial schematic representation of an alternate embodiment of a housing similar to that shown in part in FIG. 14 wherein the auger is transferring pulverized surface material to the side of the ground surface to the right of the housing as the housing moves forward (or to the left of the front of the housing as shown in the schematic drawing)
Figure 14:
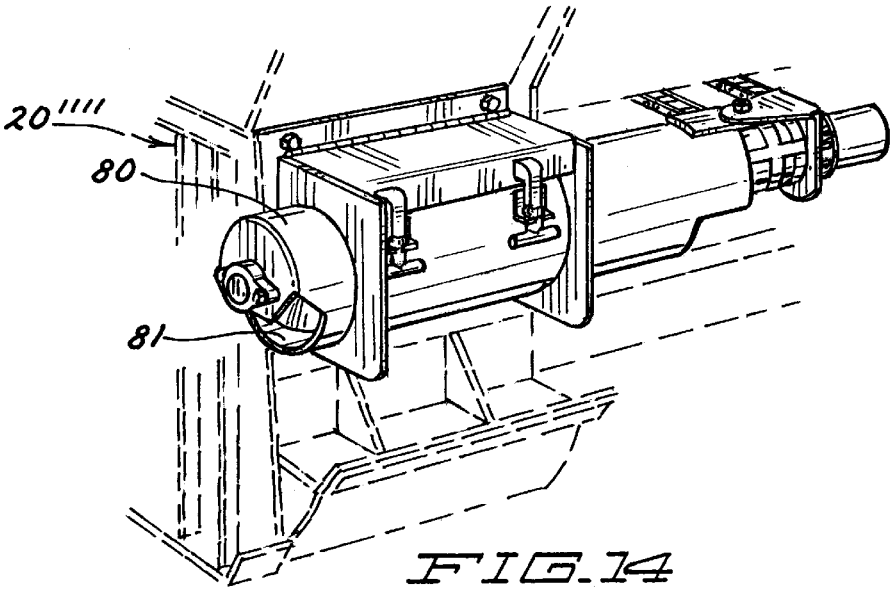
FIG. 14 shows a portion of an alternate housing in phantom and a mechanically driven auger device attached to a front plate proximate the cutter drum chamber.

Referring now also to FIGS. 14 and 15, a further alternate embodiment of the housing 20"" includes a auger device 80 having a driven auger for transporting pulverized surface materials from the cutter drum chamber 26"" to either side of the cutter drum 24"" as the cutter drum 24"" passes over the ground surface.

Figure 16:
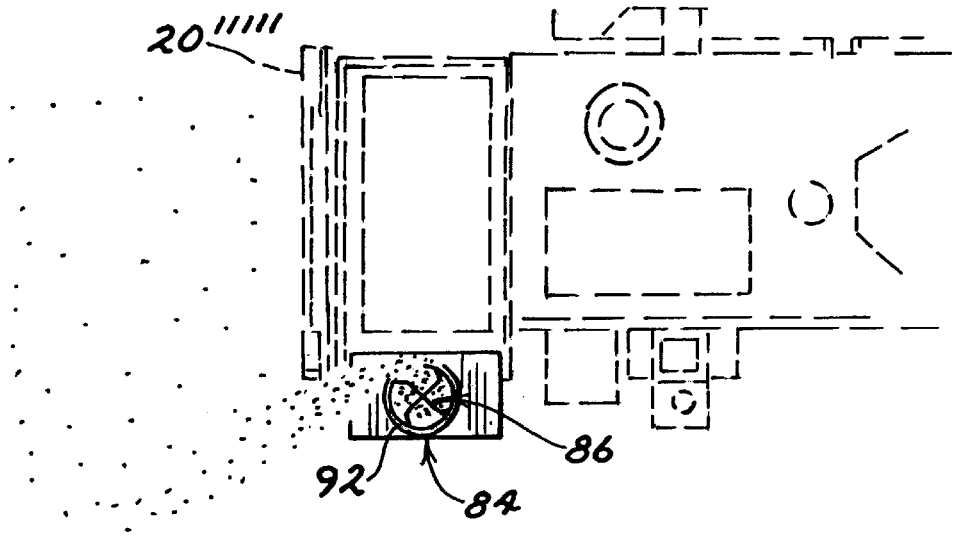
FIG. 16 is a schematic plan view of a broadcasting device similar to that shown in FIG. 17, attached to an alternate housing shown in phantom, when is used broadcasting pulverized road surface materials pulverized by the road mill cutter drum.
Figure 17:
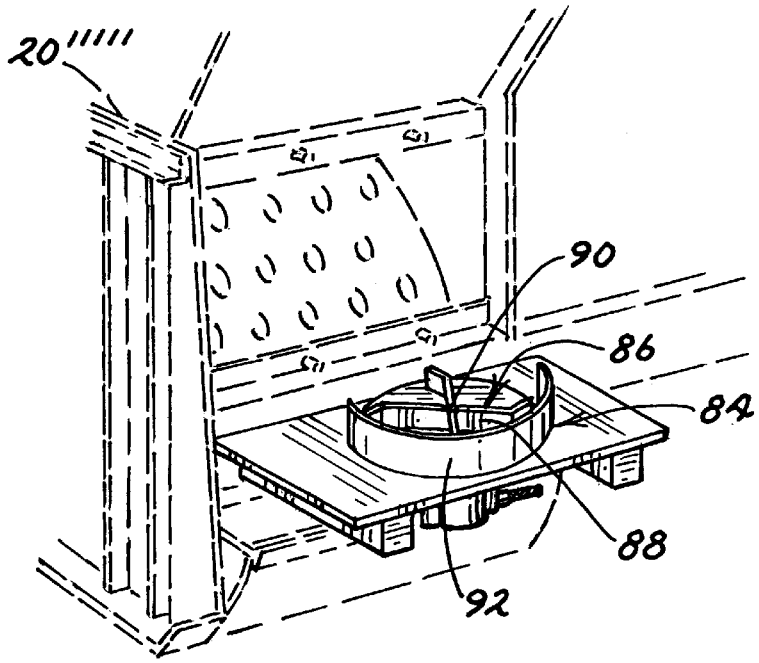
FIG. 17 is a perspective view of a broadcasting device similar to that shown in FIG. 16.

Referring now also to FIGS. 16–17, a further embodiment of the housing 20"" includes a broadcasting device 84 having a driven spinner 86 including a plurality of paddles 88 which rotate about a spinner axis 90 to throw the pulverized ground material to either side of the cutter drum 24"" (not shown) as the cutter drum passes over the ground surface 40 and pulverizes ground materials. The direction to which the spinner 86 broadcasts the pulverized material is limited by a shroud 92 which partially surrounds the spinner 86.

Figure 3:
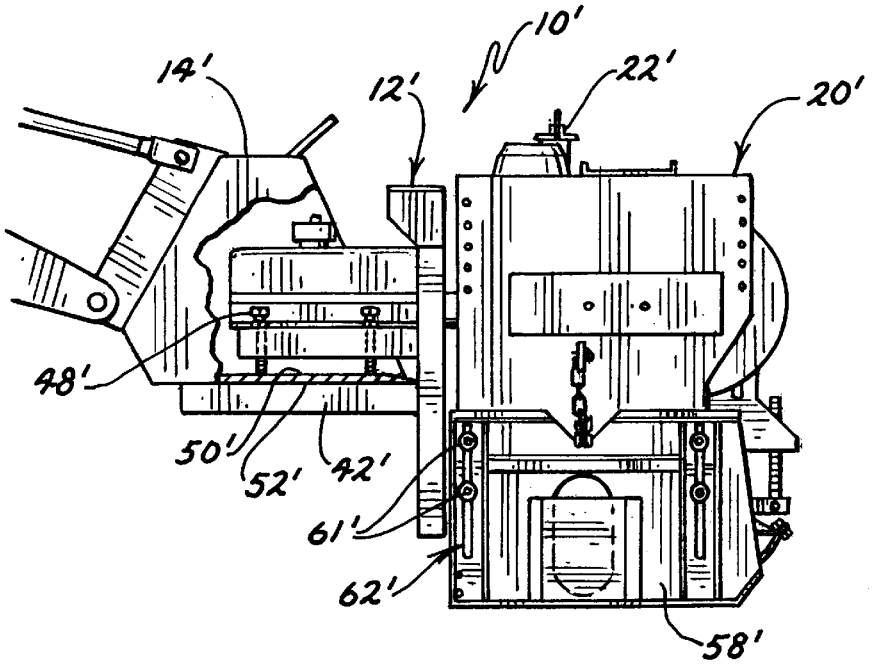
FIG. 3 is a side view of the forward mounted asphalt road mill apparatus shown in FIG. 2, but showing the loading bucket partially broken away.

Referring now also to FIGS. 18 and 20–23 a further embodiment of the mounting device 112 is shown having a plurality of tool bars 128 which are welded to a frame 127. A fuel tank 154 is secured to the mounting device as is the cylindrical cylinder 130. The alternate mounting device 112 also has a pair of U-shaped side brackets 142 including mounting pins 148 which may be tightened down upon a bottom side of a loading bucket (not shown) to secure the mounting device 112 to such a loading bucket in generally the same manner as the mounting device 12' is secured to a loading bucket 14' as shown in FIG. 3.

Figure 2:
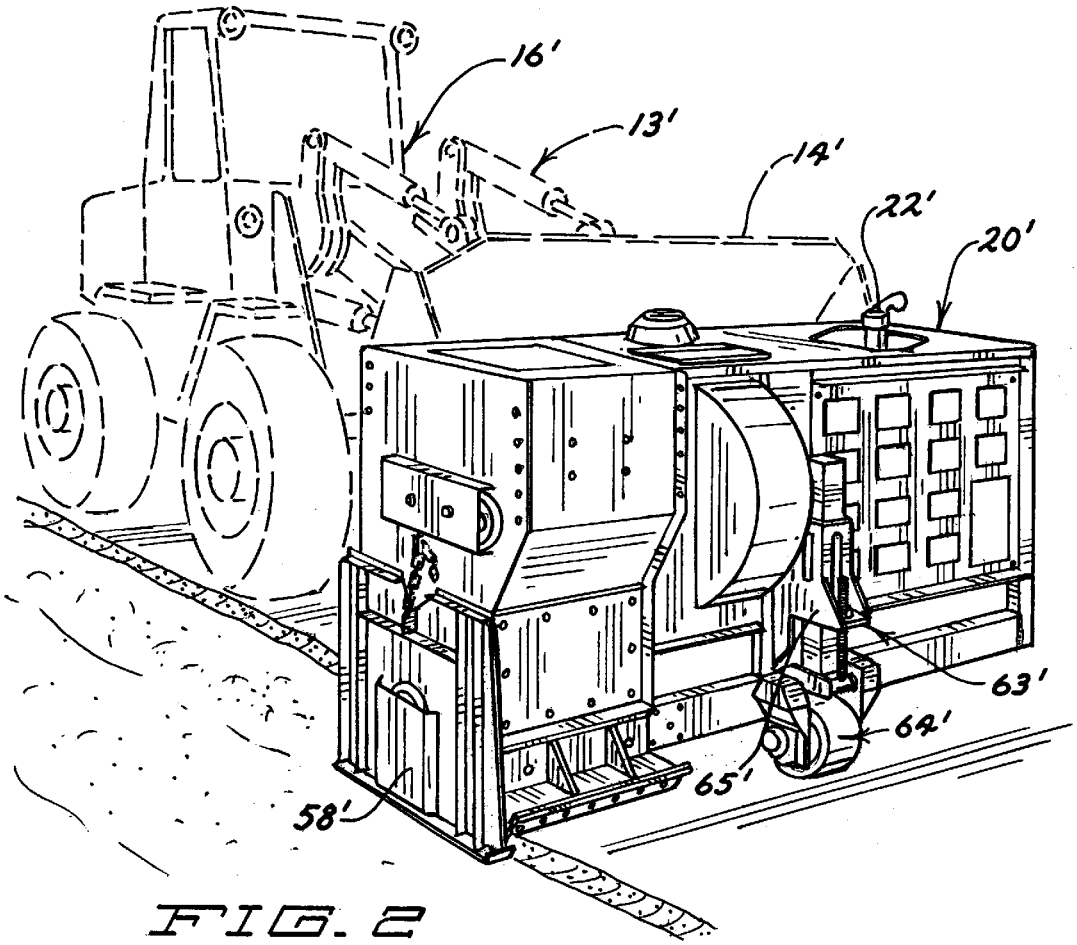
FIG. 2 is an enlarged perspective view of an alternate housing of a forward mounted asphalt road mill apparatus similar to that shown in FIG. 1, but having an adjustable depth gauge mechanism including a support wheel; the front-end loader is shown in phantom and the road mill housing is shown in an offset position relative to the loading bucket, and consequently, the front-end loader, such that the portion of the housing including the cutter drum is positioned outside of the width parameters of the outer sides of the loading bucket.

The alternate mounting device 112 includes an adjustable depth gauge 163 which is secured to two of the three tool bars 128 the third tool bar 12& to which the depth gauge 163 is not attached is shortened to make room for the support wheel 164 of the depth gauge 163. In preferred embodiments of the road mill apparatus of the present invention, the mounting device 112, shown in FIGS. 18. and 20–23 is engaged with a road mill housing 20 similar to that shown in FIG. 1, but having all the features of the road mill housing 20', shown in FIG. 2, except that the road mill housing does not include a depth gauge 63 as shown in FIG. 2. Instead, the depth gauge 163 is attached to the mounting device 112 as shown in FIGS. 18 and 20–23. In preferred embodiments, the depth gauge will be automated with electronic and/or electronic and hydraulic controls of the type known in the art, which can automatically adjust the distance between the depth gauge housing 165 and the depth gauge support wheel 164, thereby adjusting the depth of the cut made by the cutter drum 24 (not shown).

Figure 18:
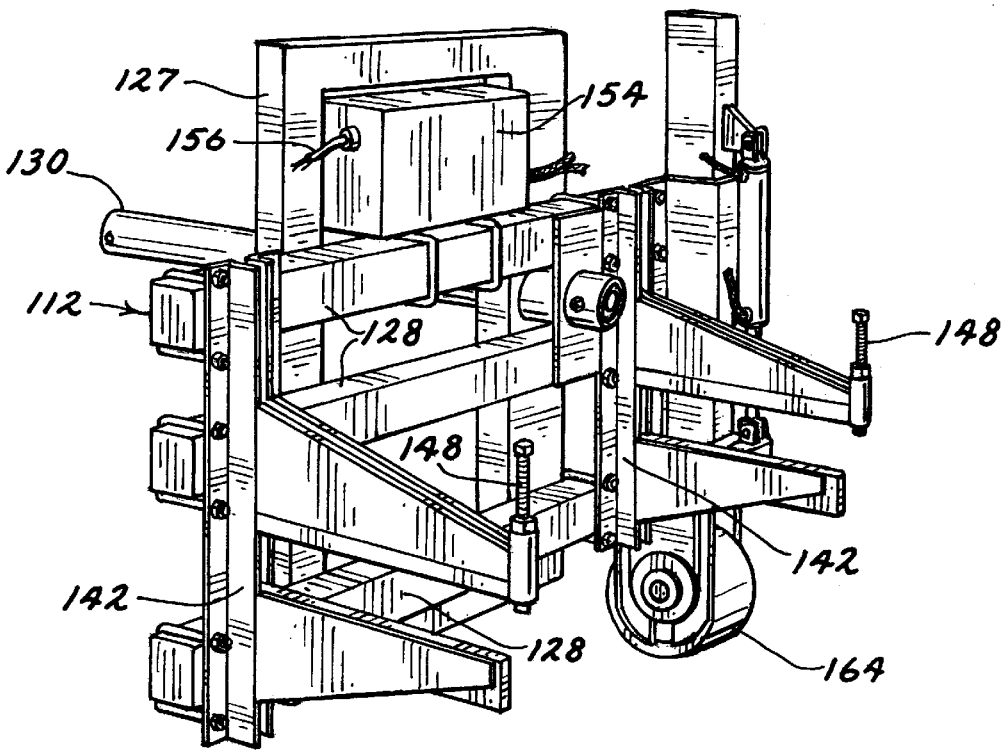
FIG. 18 is a perspective view of an alternate mounting device including a preferred bucket attachment device for mounting upon a loading bucket and supporting a forward mounted asphalt road mill apparatus.
Figure 19A:
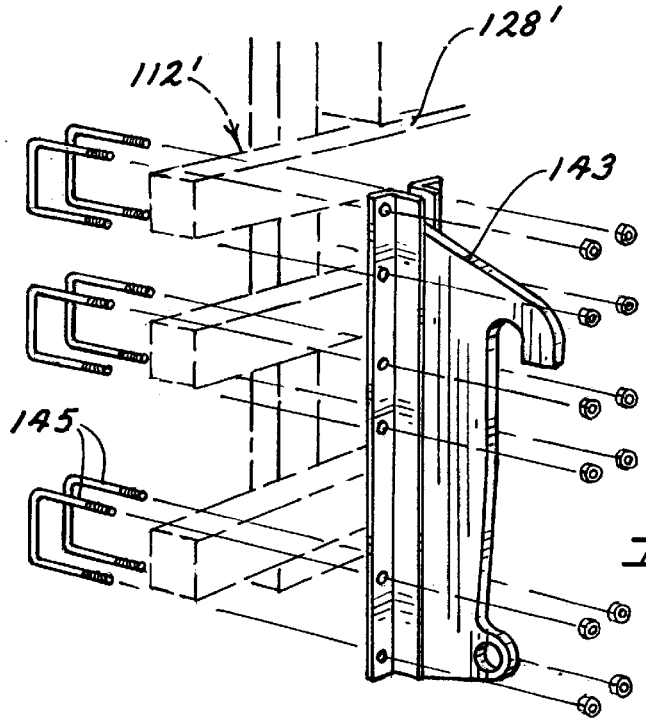
FIG. 19A is an exploded partial perspective view of a portion of an alternate mounting device similar to that shown in FIG. 18, but showing the tool bars in phantom and only one of the two hook-like catch extensions attached to the tool bars in place of the bucket attachment device shown in FIG. 18.
Figure 19B:
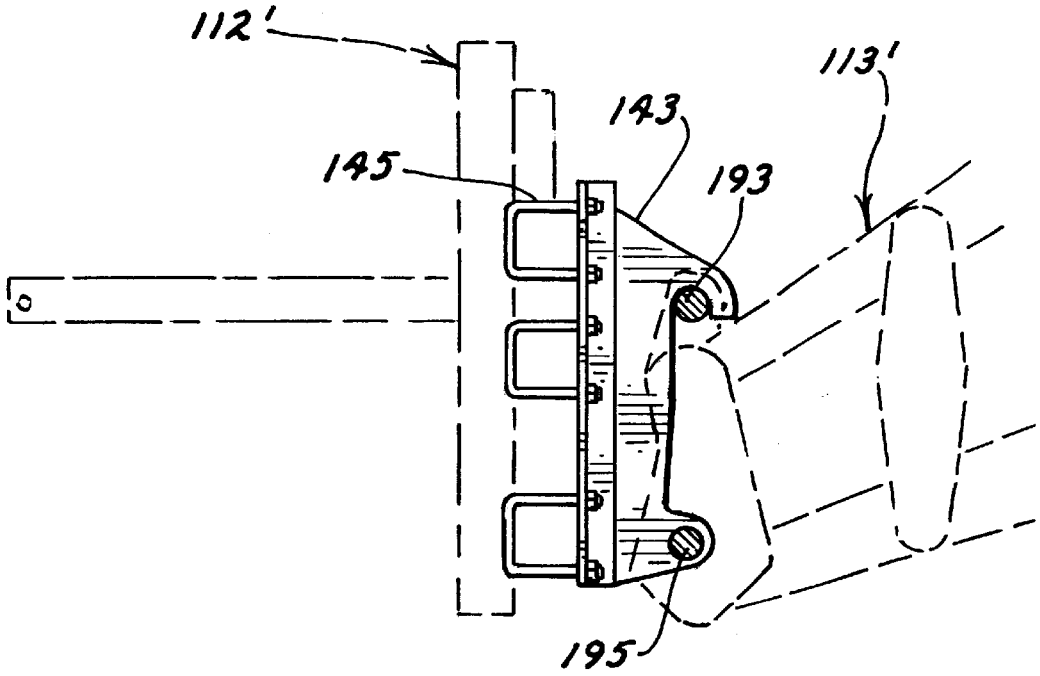
FIG. 19B is a side view of an alternate mounting device similar to that shown in FIG. 19A, but showing the hook-like catch extensions (far side not visible) secured to the tool bars shown in phantom and engaged with a standard "quick attach" attachment mechanism which is shown in phantom.
Figure 21:
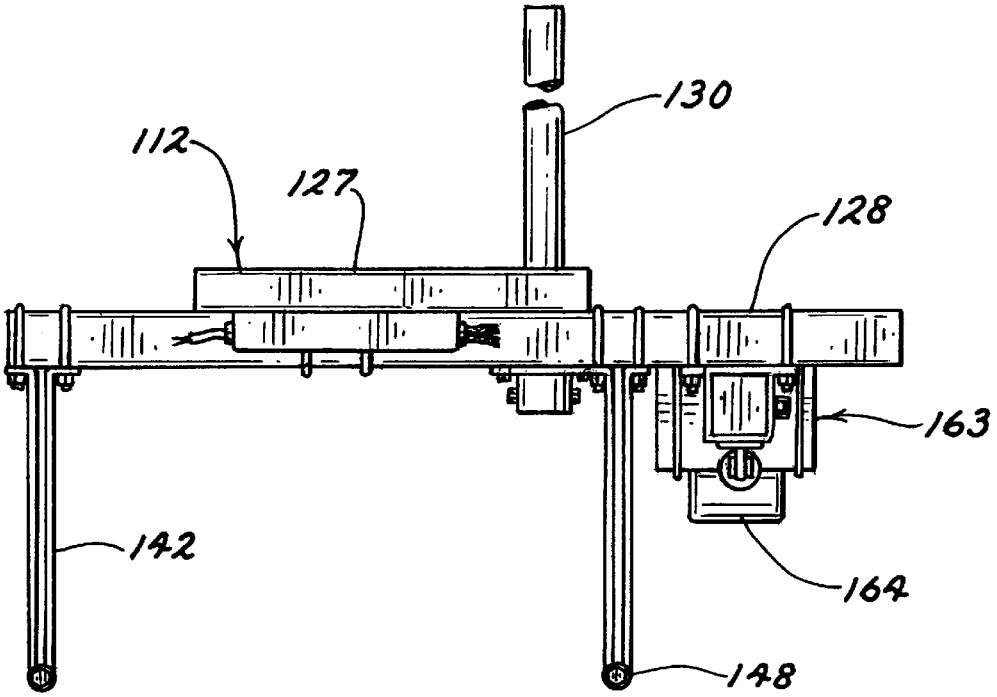
FIG. 21 is a top view of the mounting device shown in FIG. 18.
Figure 20:
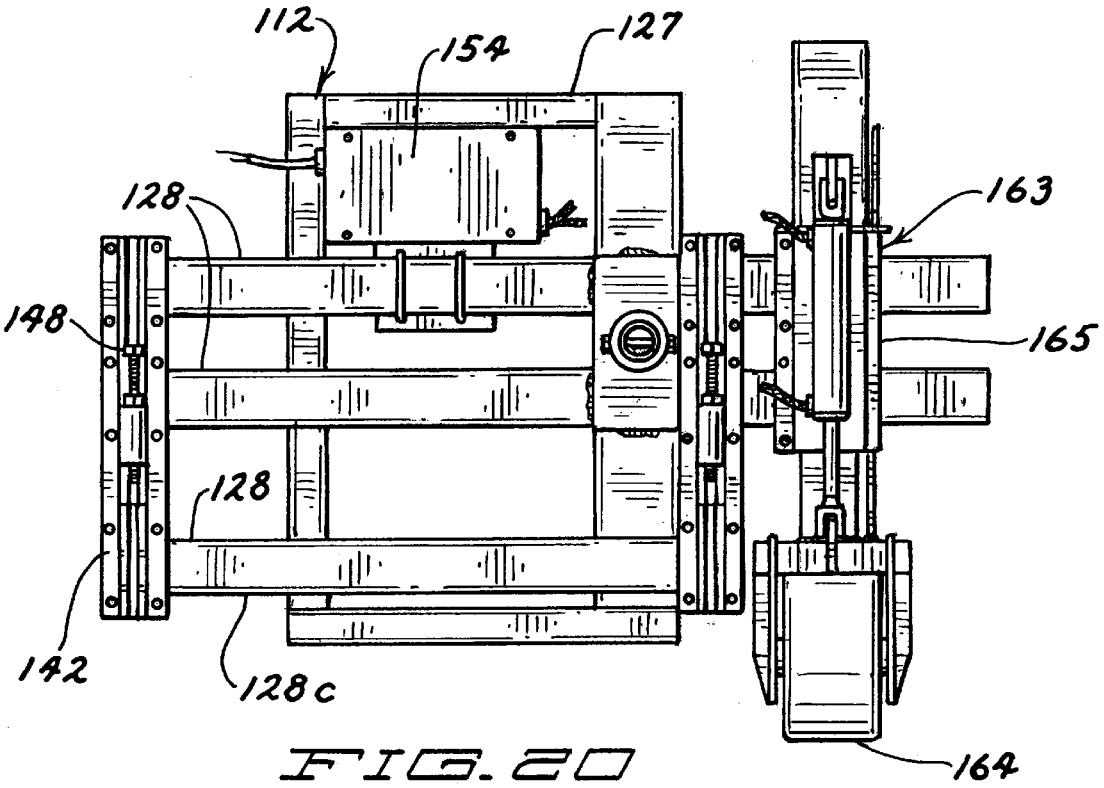
FIG. 20 is a front view of the mounting device shown in FIG. 18.
Figure 22:
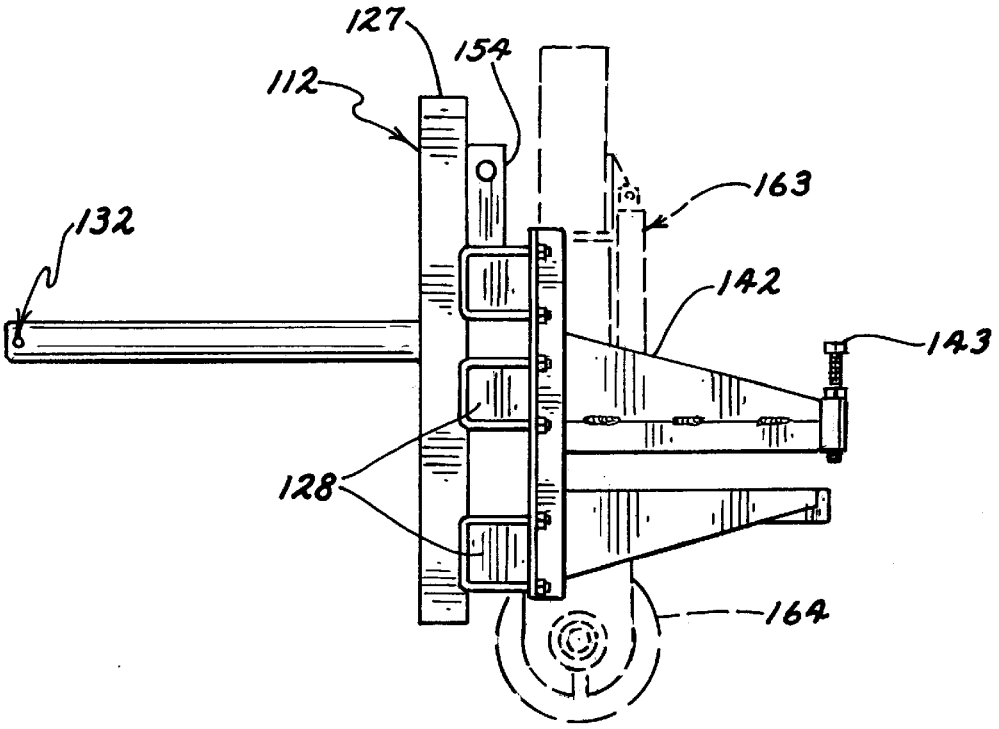
FIG. 22 is a side view of the mounting device shown in FIG. 18 with the adjustable depth setting support wheel on the far side thereof shown in phantom.
Figure 23:
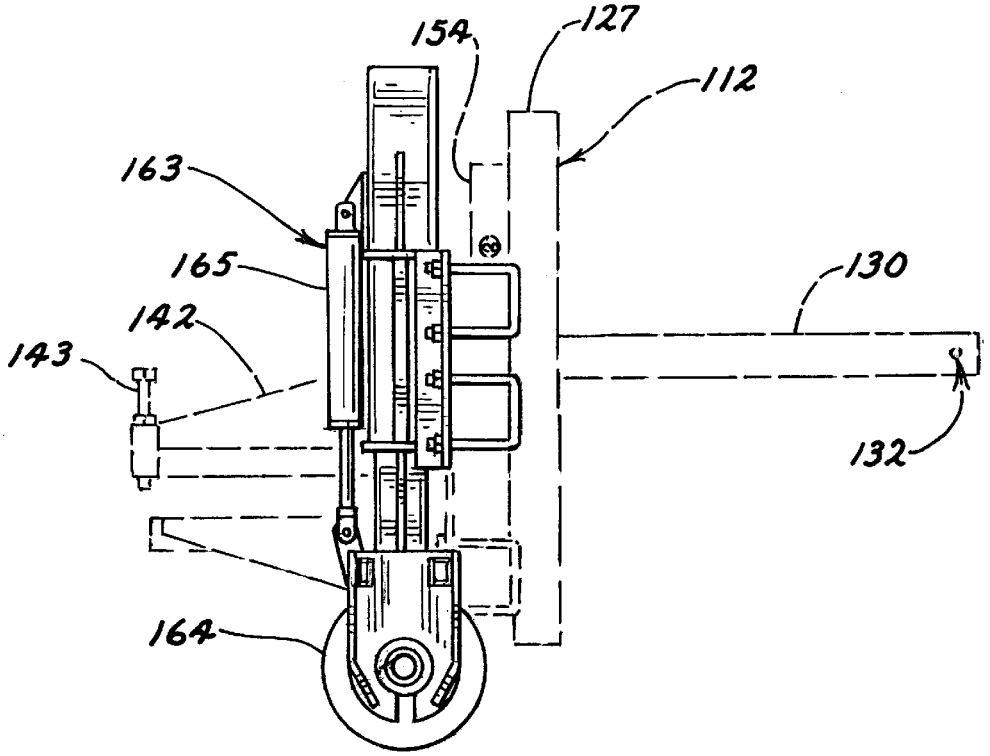
FIG. 23 is a side view of the bucket mounting apparatus shown in FIG. 18 with the portions of the mounting apparatus with the exception of the adjustable depth setting support wheel shown in phantom.

Referring now also to FIGS. 19A and 19B, a further embodiment of the mounting device 112' is provided where the U-shaped side pieces 142 of the mounting device 112 shown in FIG. 18 are interchanged for a pair of hook-like extension brackets 143 which are secured to the respective tool bars 128' with a series of u-bolts 145 in a manner similar to that shown in FIG. 18. This alternate mounting device 112' will include the remaining features of the mounting device 112 shown in FIG. 18, but will not be secured to a loading bucket. Instead, a standard front and loading attachment mechanism having a catch bar 193 and a pair of securing pins 195 will engage the respective hook-like extension brackets 143 to lift the alternate mounting device 112' as shown in FIG. 19B.

It is to be understood, however, that even though numerous characteristics and advantages of the present invention have been set forth in the foregoing description, together with details of the structure and function of present invention, the sequence or order of the specific steps, or the actual compositions or materials used may vary somewhat. Further more, it will be appreciated that this disclosure is illustrative only and that changes may be made in detail, especially in matters of shape, size, arrangement of parts or sequence or elements of aspects of the invention within the principles of the invention to the full extent indicated by the broad general meaning of the terms in which the appended claims are expressed.

What is claimed is:

1. An road mill apparatus for attachment to and use in conjunction with a land vehicle, the land vehicle including a lifting mechanism which can be raised or lowered during use; the road mill apparatus comprising:

a) a road mill housing including a rotatable cutter drum and a mechanism for driving the cutter drum such that the cutter drum rotates at a speed sufficient to grind or cut asphalt roadway surface material, the housing further including a shaft receiving opening; and b) a mounting device for attachment to the land vehicle, the mounting device including a cylindrical shaft extends within the housing and which substantially supports the weight of the housing once the shaft is received within the shaft receiving opening of the housing.

2. The road mill apparatus of claim 1, further comprising an adjustable length connecting arm interconnecting the housing and the mounting device; wherein the housing can pivot about the cylindrical shaft in a generally vertical plane when the cylindrical shaft is in a generally horizontal orientation and the connecting arm is oriented with respect to the housing and the mounting device such that the housing will pivot about the cylindrical shaft with respect to the mounting device when the length of the connecting arm is adjusted.

3. The road mill apparatus of claim 2, wherein the connecting arm is hydraulic cylinder.

4. The road mill apparatus of claim 3, further comprising remote electronic means for actuating the hydraulic cylinder to adjust the length thereof and thereby pivot the housing in a generally vertical plane with respect to the generally horizontal plane in which the cylindrical shaft resides.

5. The road mill apparatus of claim 1, the lifting mechanism of the land vehicle including a catch bar extending generally horizontally when the land vehicle is in an uptight position, the mounting device including a pair of hook-like catch extensions designed and constructed to engage the catch bar when the catch bar is positioned below the catch extensions and raised to engage the catch extensions.

6. The road mill apparatus of claim 1, wherein the land vehicle is a front-end loader having a loading bucket, the mounting device including a mounting frame including a pair of interconnected generally U-shaped side pieces, the respective U-shaped side pieces each providing an engagement opening for receiving a front edge of a bottom side of the loading bucket.

7. The road mill apparatus of claim 6, the mounting frame including mounting pins which can be screwed down onto a top surface of the bottom side of the loading bucket when the bottom side of the bucket is positioned within the respective engagement openings so as to secure the bottom side within the engagement openings.

8. The road mill apparatus of claim 6, the lift mechanism of the land vehicle including a forward mounted loading bucket, the loading bucket having a standard bucket width of eight feet, the cutting drum having drum diameter and a drum width and the mounting frame having a frame width, the frame width being no greater than the standard bucket width less the drum width such that the frame can be engaged with the bucket in a position wherein the entire drum width extends beyond the width of the loading bucket when the mount device is engaged therewith and the housing is secured upon the cylindrical shaft.

9. The road mill apparatus of claim 6, further comprising an adjustable length connecting arm interconnecting the housing and the mounting device; wherein the housing can pivot about the cylindrical shaft in a generally vertical plane when the cylindrical shaft is in a generally horizontal orientation and the connecting arm is oriented with respect to the housing and the mounting device such that the housing will pivot about the cylindrical shaft with respect to the mounting device when the length of the connecting arm is adjusted.

10. The road mill apparatus of claim 9, wherein the connecting arm is hydraulic cylinder.

11. The road mill apparatus of claim 10, further comprising remote electronic means for actuating the hydraulic cylinder to adjust the length thereof and thereby pivot the housing in a generally vertical plane with respect to the generally horizontal plane in which the cylindrical shaft resides.

12. The road mill apparatus of claim 1 further comprising:

liquid storage and application means for applying a liquid having desired properties to material which is pulverized by the cutter drum during the operation of the road mill apparatus.

13. The road mill apparatus of claim 1 further comprising:

an auger device attached to the housing proximate the cutter drum for displacing material pulverized by the cutter drum during the operation of the road mill apparatus.

14. The road mill apparatus of claim 1 further comprising:

a conveyor device interconnected with the housing proximate the cutter drum for displacing material pulverized by the cutter drum during the operation of the road mill apparatus.

15. The road mill apparatus of claim 1 further comprising:

a broadcasting device for throwing material pulverized by the cutter drum during the operation of the road mill apparatus away from the housing, the broadcasting device including at least one rotating paddle for projecting pulverized materials away from the housing and a shroud for preventing the projection of pulverized materials in all 360 degrees from an axis about which at least one rotating paddle rotates.

16. The road mill apparatus of claim 1, wherein the mounting device includes a depth adjustment mechanism.

17. The road mill apparatus of claim 16, wherein the housing includes a depth adjustment mechanism includes a support wheel which can be raised or lowered.

18. The road mill apparatus of claim 1, wherein the housing includes a depth adjustment mechanism including a support wheel which can be raised or lowered.

19. A mounting device for attachment of a working machine to a land vehicle, the land vehicle including a lifting mechanism which is capable of raising or lowering the working machine during use of the land vehicle when the working machine is attached thereto, the working machine having a housing including working parts and a shaft receiving opening; the mounting device comprising an attachment device for attachment to the land vehicle and a cylindrical shaft upon which the working machine can be secured once the shaft is received within the shaft receiving opening of the working machine; wherein the shaft is interconnected with said attachment device such that the shaft extends within the housing so as to support the weight of the working machine when the lifting mechanism is used to raise the working machine.

20. The mounting device of claim 19, wherein the lifting mechanism of the land vehicle includes a catch bar extending generally horizontally when the land vehicle is in an upright position, the mounting device including a pair of hook-like catch extensions designed and constructed to engage the catch bar when the catch bar is positioned below the catch extensions and raised to engage the catch extensions.

21. The mounting apparatus of claim 20, further comprising an adjustable length connecting arm interconnecting the housing and the mounting device; wherein the working machine can pivot about the cylindrical shaft in a generally vertical plane when the cylindrical shaft is in a generally horizontal orientation and the connecting arm is oriented with respect to the working machine and the mounting device such that the housing will pivot about the cylindrical shaft with respect to the mounting device when the length of the connecting arm is adjusted.

22. The mounting apparatus of claim 21, wherein the connecting arm is a hydraulic cylinder.

23. The mounting apparatus of claim 22, further comprising remote electronic means for actuating the hydraulic cylinder to adjust the length thereof and thereby pivot the working machine in a generally vertical plane with respect to the generally horizontal plane in which the cylindrical shaft resides.

24. The mounting apparatus of claim 23, wherein the mounting device includes a depth adjustment mechanism which can be actuated by said remote electronic actuating means.

25. The mounting apparatus of claim 20, wherein the mounting device further includes pin receiving openings for receiving securing pins for securing the mounting device to the lifting mechanism.

26. The mounting apparatus of claim 19, wherein the land vehicle is a front-end loader having a loading bucket, the mounting device including a mounting frame including a pair of interconnected generally U-shaped side pieces, the respective U-shaped side pieces each providing an engagement opening for receiving a front edge of a bottom side of the loading bucket.

27. The mounting apparatus of claim 26, the mounting frame including mounting pins which can be screwed down onto a top surface of the bottom side of the loading bucket when the bottom side of the bucket is positioned within the respective engagement openings so as to secure the bottom side within the engagement openings.

28. A forward mounted asphalt road mill apparatus for attachment to and use in conjunction with a front-end loading land vehicle having a loading bucket which may be raised or lowered forward of the land vehicle during use thereof, the loading bucket being constructed of substantial material which can support a load of at least 1000 pounds, the bucket having a top side and a bottom side, a left side and a right side, the top side and the bottom side extending from the left side to the right side and the bottom side having a front edge; the road mill apparatus comprising:

a) a road mill housing including a rotatable cutter drum and a mechanism for driving the cutter drum such that the cutter drum rotates at a speed sufficient to grind or cut asphalt; and b) a bucket mounting device for attachment to the bucket, the mounting device including a cylindrical shaft upon which the housing can be secured; the housing further including a shaft receiving opening; wherein the cylindrical shaft substantially sports the weight of the road mill housing when the housing is secured upon the cylindrical shaft.

29. The road mill apparatus of claim 28, further comprising an adjustable length connecting arm interconnecting the housing and the bucket mounting device; wherein the housing can pivot about the cylindrical shaft in a generally vertical plane when the cylindrical shaft is in a generally horizontal orientation and the connecting arm is oriented with respect to the housing and the bucket mounting device such that the housing will pivot about the cylindrical shaft with respect to the mounting device when the length of the connecting arm is adjusted.

30. The road mill apparatus of claim 29, wherein the connecting arm is hydraulic cylinder.

31. The road mill apparatus of claim 30, further comprising remote electronic means for actuating the hydraulic cylinder to adjust the length thereof and thereby pivot the housing in a generally vertical plane with respect to the generally horizontal plane in which the cylindrical shaft resides.

32. The road mill apparatus of claim 28, the bucket mounting device including a mounting frame including a pair of interconnected generally U-shaped side pieces, the respective U-shaped side pieces each providing an engagement opening for receiving the front edge of the bottom side of the loading bucket when the bucket mounting device is engaged with the bucket.

33. The road mill apparatus of claim 32, the mounting frame including mounting pins which can be screwed down onto a top surface of the bottom side of the loading bucket when the bottom side of the bucket is positioned within the respective engagement openings, so as to secure the bottom side within the engagement openings.

34. The road mill apparatus of claim 33, each of the generally U-shaped side pieces including at least one engagement pin.

35. The road mill apparatus of claim 28, the bucket mounting device including a mounting frame, the road mill apparatus being arranged and constructed for attachment to and use with the land vehicle having a forward mounted loading bucket, the loading bucket having a standard bucket width of eight feet, the cutter drum having diameter and a width and the mounting frame having a width, the width of the mounting frame being no greater than the standard width of the bucket less the width of the cutter drum such that the frame can be engaged with the bucket in a position wherein the entire width of the cutter drum extends beyond the width of the loading bucket when the bucket mounting device is engaged therewith and the housing is secured upon the cylindrical shaft.

36. The road mill apparatus of claim 28 further comprising:

liquid storage and application means for applying a liquid having desired properties to material which is pulverized by the cutter drum during the operation of the road mill apparatus.

37. The road mill apparatus of claim 28 further comprising:

an auger device attached to the housing proximate the cutter drum for displacing material pulverized by the cutter drum during the operation of the road mill apparatus.

38. The road mill apparatus of claim 28 further comprising:

a conveyor device interconnected with the housing proximate the cutter drum for displacing material pulverized by the cutter drum during the operation of the road mill apparatus.

39. The road mill apparatus of claim 28 further comprising:

a broadcasting device for throwing material pulverized by the cutter drum during the operation of the road mill apparatus away from the housing, the broadcasting device including at least one rotating paddle for projecting pulverized materials away from the housing and a shroud for preventing the projection of pulverized materials in all 360 degrees from an axis about which at least one rotating paddle rotates.

40. A bucket mounting device for attachment of a working machine to a front-end loading land vehicle having a loading bucket which may be raised or lowered forward of the land vehicle during use thereof, the loading bucket having a top side and a bottom side, a left side and a right side, the top side and the bottom side extending from the left side to the right side and the bottom side having a front edge, the working machine having a housing, the housing including a shaft receiving opening; the bucket mounting device comprising a cylindrical shaft upon which the housing can be secured once the shaft is received within the shaft receiving opening; the bucket mounting device further including a mounting frame including a pair of interconnected generally U-shaped side pieces, the respective U-shaped side pieces each providing an engagement opening for receiving the font edge of the bottom side of the loading bucket when the mounting device is engaged with the bucket; wherein the cylindrical shaft substantially sorts the weight of the road mill housing when the housing is secured upon the cylindrical shaft.

41. The bucket mounting apparatus of claim 40, further comprising an adjustable length connecting arm interconnecting the housing and the bucket mounting device; wherein the housing can pivot about the cylindrical shaft in a generally vertical plane when the cylindrical shaft is in a generally horizontal orientation and the connecting arm is oriented with respect to the housing and the bucket mounting device such that the housing will pivot about the cylindrical shaft with respect to the mounting device when the length of the connecting arm is adjusted.

42. The bucket mounting apparatus of claim 41, wherein the connecting arm is a hydraulic cylinder.

43. The bucket mounting apparatus of claim 42, further comprising remote electronic means for adjusting the length of the adjustable connecting arm and thereby pivoting the housing in a generally vertical plane with respect to a generally horizontal plan in which the bucket mounting device resides.

44. The bucket mounting apparatus of claim 43, the mounting frame including mounting pins which can be screwed down onto a surface of the bottom side of the loading bucket when the bottom side of the bucket is positioned within the respective engagement openings, so as to secure the bottom side within the engagement openings.

45. The bucket mounting apparatus of claim 44, each of the generally U-shaped side pieces including at least one engagement pin.

* * * * *

UNITED STATES PATENT AND TRADEMARK OFFICE

CERTIFICATE OF CORRECTION

PATENT NO. : 6,227,620 B1
DATED : May 8, 2001
INVENTOR(S) : James H. Page

It is certified that error appears in the above-identified patent and that said Letters Patent is hereby corrected as shown below:

Column 1,
Line 29, delete the second "surfacing" and insert therefor -- resurfacing --

Column 3,
Line 49, delete "sect" and insert therefor -- respect --

Column 10,
Line 1, delete "uptight" and insert therefor -- upright --

Column 14,
Line 13, delete "sorts" and insert therefor -- supports --

Signed and Sealed this

Twenty-second Day of April, 2003

JAMES E. ROGAN
*Director of the United States Patent and Trademark Office*